United States Patent [19]

Weirich et al.

[11] Patent Number: 5,060,556

[45] Date of Patent: Oct. 29, 1991

[54] ARRANGEMENT FOR EMERGENCY OPERATION OF HYDRAULIC APPLIANCE IN AN ELECTRO-HYDRAULICALLY CONTROLLED MINERAL MINING INSTALLATION

[75] Inventors: Walter Weirich, Dortmund; Michael Dettmers, Kamen; Uwe Trox, Ottmarsbocholt, all of Fed. Rep. of Germany

[73] Assignee: Gewerkschaft Eisenhutte Westfalia GmbH, Fed. Rep. of Germany

[21] Appl. No.: 590,560

[22] Filed: Sep. 28, 1990

Related U.S. Application Data

[63] Continuation of Ser. No. 441,615, Nov. 27, 1989, abandoned.

[30] Foreign Application Priority Data

Dec. 1, 1988 [DE] Fed. Rep. of Germany ..... 3840478

[51] Int. Cl.[5] ..... F15B 13/07

[52] U.S. Cl. ..... 91/527; 91/427; 91/529; 137/596.16; 137/884; 405/302

[58] Field of Search ..... 91/427, 527, 529; 137/596.16, 884; 405/302

[56] References Cited

U.S. PATENT DOCUMENTS

| | | | |
|---|---|---|---|
| 4,159,671 | 7/1977 | Allen | 91/427 X |
| 4,327,628 | 5/1982 | Weirich et al. | 91/529 X |
| 4,702,148 | 10/1987 | Kussel et al. | 91/529 X |

*Primary Examiner*—Gerald A. Michalsky

*Attorney, Agent, or Firm*—Samuels, Gauthier & Stevens

[57] ABSTRACT

An electro-hydraulic control system for a mineral mining installation has a series of valve blocks, each contain a number of valves which are operated in dependence on electrical signals to cause hydraulic appliances of roof supports to operate. To allow emergency operation, when there is a power failure or when the control system fails or is otherwise inoperative, further manually operable valves are connected by a flexible, multicore connecting cable to the valve block of the associated support. The emergency control valves can operate hydraulically controllable direction control valves of the control system and by-pass the electrical controls. The support can then be controlled purely hydraulically, at least in its main functions, using the emergency device.

7 Claims, 3 Drawing Sheets

ARRANGEMENT FOR EMERGENCY OPERATION OF HYDRAULIC APPLIANCE IN AN ELECTRO-HYDRAULICALLY CONTROLLED MINERAL MINING INSTALLATION

This is a continuation of copending application Ser. No. 07/ 441,615 filed on 11/27/89, now abandoned.

FIELD OF THE INVENTION

The invention relates to electro-hydraulic control systems for mineral mining installations and more particularly to an arrangement usable for operating hydraulic appliances of the installation in an emergency.

BACKGROUND ART

In known electro-hydraulic control systems, electronic control devices are allocated to the individual roof supports together with valves assembled as valve blocks. The valves consist of or include direction control valves which are connected on the inlet side to an hydraulic pressure and return line and on the outlet side to the working chambers of hydraulic appliances.

Electro-hydraulic support control systems of various designs are known (See "Gluckauf" 1981, pages 155–162; "Gluckauf" 1984, pages 135–140; "Gluckauf" 1986, pages 1183–1187). In modern mining practice, preference is given to control systems which are decentralised and in which each roof support along the longwall face is provided with an individual electronic control device with a microprocessor. The individual control devices are then coupled to one another and optionally also to a central control station via data transmission cables. The individual control devices are each provided with an operator's access station with a keyboard, by means of which various control processes can be initiated. The system is supplied with power by means of intrinsically safe power sources, and an electronic control device or a group of electronic control devices can be connected to each power source.

To achieve the intrinsic safety required in underground mining with minimum consumption of electric energy, it is known from DE-OS 35 30 657 to use electrically controllable solenoid valves as pilot valves in the hydraulic control lines of the direction control valves in such a way that these direction control valves are controlled solely by the pilot valves which can be switched without pressure by electrical energy. The valves of the support which are combined to form valve blocks therefore comprise, in addition to the hydraulically controllable direction control valves, a number of solenoid valves which can be electrically controlled individually or in groups by the associated control device. This control system performs satisfactorily during normal conditions but electrical faults or power failure can disable the system and can result in danger to personnel. An object of the invention is to provide a simple emergency arrangement for an electro-hydraulic control system, with which at least the most important functions of the supports can be intentionally and reliably controlled from a safe position even during a power failure or during a failure of the electronic controls.

BRIEF SUMMARY OF THE INVENTION

According to the invention, the hydraulic control lines between the hydraulic outlets of the solenoid valves and the control inlets of the direction control valves of a known electro-hydraulic system are connected to coupling means to which a portable hydraulic emergency control device provided with manually actuated emergency control valves can be coupled via a multi-core hydraulic connecting cable.

By using such an emergency arrangement the normal electrical controls are by-passed and any support can also be operated purely hydraulically, if necessary, thereby avoiding the electronic control devices and without the co-operation of the electrically actuated solenoid valves. The basic electro-hydraulic control system is thus broadened with respect to the method of controlling the working appliances, without significant additional expenditure.

The emergency arrangement preferably allows the valves of the supports to be intentionally controlled from a safe position, i.e. generally from some adjacent location, during an electric power failure, a failure of the electronic controls or during some other condition, for example during assembly, dismantling or modification of the supports. For convenience this is referred to simply as "emergency operation". The emergency operation proposed according to the invention allows reliable control of the supports at least in the main functions, e.g. involving setting and retraction of the props, shifting the conveyor and advancing the support, while avoiding the electronic controls. It goes without saying that the connecting cable linked to the emergency control device should be sufficiently long for the emergency operation to be carried out from a protected position, i.e. in the protection of an adjacent support. A cable length of about 1.5 to 2.5 m is generally sufficient for this purpose. If the emergency operation according to the invention is restricted to the most important functions, this results in an emergency control device with small dimensions which is relatively simple in construction and can be portable permitting emergency operation of any of the supports along the longwall face.

To achieve a simple design for the emergency operation arrangement, it is advantageous if change-over valves to which branch lines leading to coupling means for receiving the cable are connected are arranged in the hydraulic control lines. It is also advantageous if the hydraulic pressure line and the hydraulic return line of the associated valve unit or block are also connected to the coupling means via corresponding branch lines. These branch lines consequently produce the hydraulic connections leading to the inlets of the emergency control valves. It is advisable to arrange a check valve, in front of the coupling means in the branch line connected to the hydraulic pressure line. This check valve only needs to be opened when the respective support is driven purely hydraulically during the emergency operation.

The above-mentioned coupling means is preferably formed on a connecting strip or the like which is mounted on the valve block of the associated support and consists of a metal plate provided with the bores serving to connect the various hydraulic lines. The change-over valves can also be arranged in the connecting strip.

The present invention provides a mineral mining installation comprising a plurality of supports equipped with hydraulic applicances and an electro-hydraulic control system for controlling the operation of the hydraulic appliances; said system comprising electronic control devices and valve units allocated to the supports the valve units consisting of hydraulically controllable direction control valves which are connected on an inlet side to hydraulic pressure and return lines and on an outlet side to pressure chambers of the appliances, and solenoid pilot valves which are controlled electrically by the associated control device and are arranged in hydraulic control lines of the control valves; and an arrangement for effecting emergency operation of the appliances said arrangement comprising a portable device with further manually actuatable control valves, and a multi-core cable for connecting the further valves to one of said valve units to provide hydraulic pressure to the control lines of the control valves to operate these valves.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
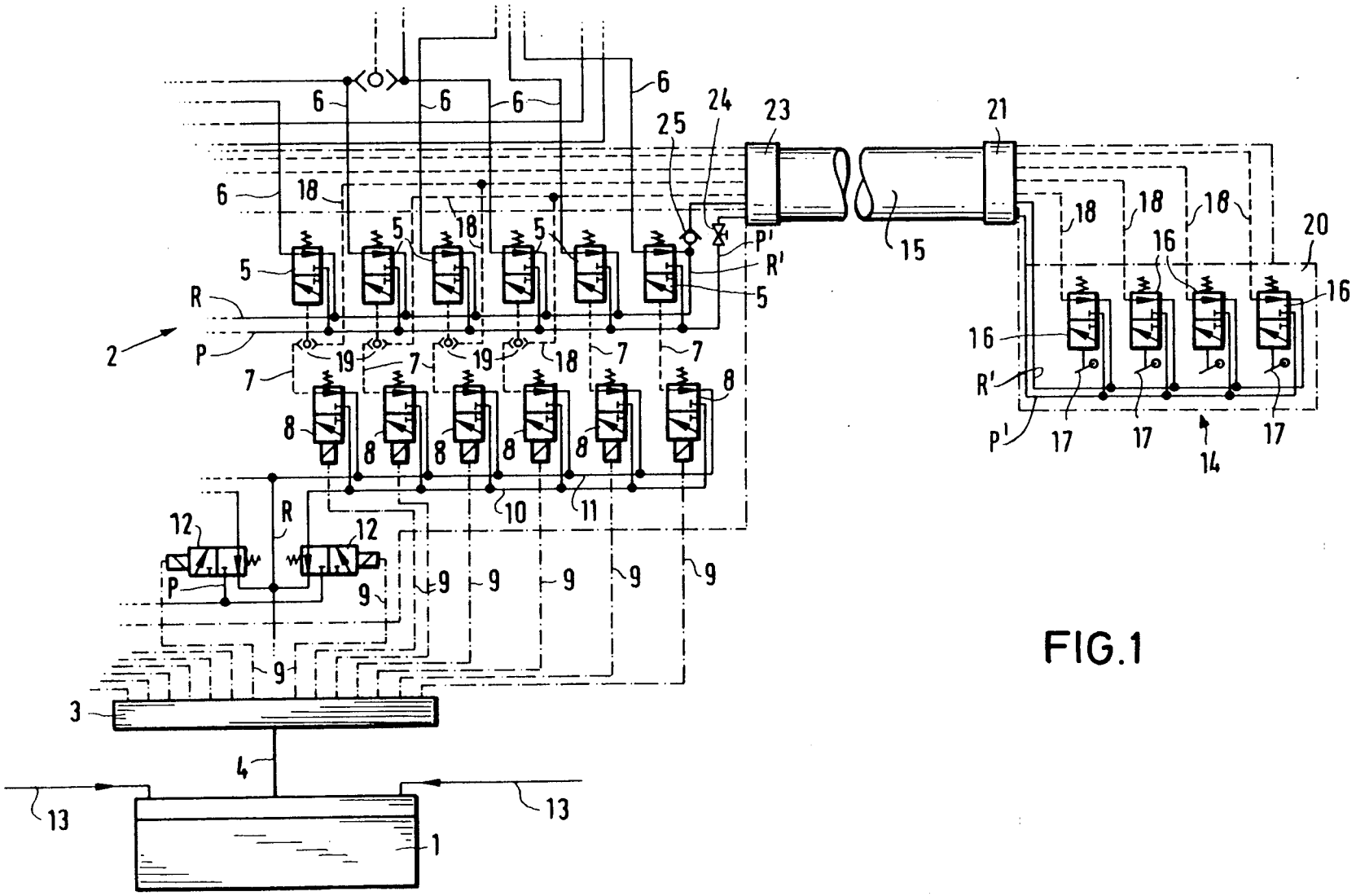
FIG. 1 is a schematic representation of part of an electro-hydraulic control system together with an emergency operation arrangement in accordance with the invention.

The design of the electrohydraulic control system depicted in FIG. 1 is known and need not therefore be explained in great detail. Each individual support unit, for example a support shield or support chock, of a mine installation is provided with an electronic control device 1 and a valve unit 2 which comprises a number of valves combined in a valve block. The number of valves depends upon the number of hydraulic working appliances (e.g. shifting rams, pops, return and advancing units, gap covering devices, corner cylinders, slide bar devices etc.) to be controlled. As known, the individual control device 1 employs electronic control means and an operator's access panel consisting of a keyboard or the like. In the embodiment illustrated, the control device 1 is also provided with a control unit 3 for the individual or group control of the various electrically actuated solenoid valves, which is coupled via an electric control line 4 to the control device 1. The control unit 3 can also be connected to the control device 1 to form a constructional unit, therewith.

The various hydraulic appliances of the associated support unit are not shown in FIG. 1, but the relevant working chambers are connected to direction control valves 5 (main control valves). The valves 5 are each connected on the inlet side to a central hydraulic pressure line P and a central hydraulic return line R and on the outlet side, via a line 6, to the respective hydraulic working pressure chamber (piston chamber or annular chamber) of the associated hydraulic appliance. The control valves 5 are hydraulically controlled via hydraulic control lines 7. When the relevant control line 7 is loaded with pressure, the associated control valve 5 is consequently switched over from the position shwon in FIG. 1 into the other position in which the line 6 is connected either to the pressure line P or to the return R. The control valves 5 are reset by spring force into the position shown when the pressure in the hydraulic control lines 7 falls.

Solenoid valves 8 which can be controlled individually or in groups via electric control lines 9 directly from the control device 1 or from the control device 1 via the electronic control unit 3 are located in the hydraulic control lines 7. The solenoid valves 8 are preferably pilot valves which can be switched without pressure and are connected to lines 10 and 11 at the inlet side. The line 11 is connected to the hydraulic return and the line 10 is connected to the outlet of a further solenoid valve 12 which can also be controlled via an electric control line 9 from the control device 1 or the control unit 3. On the inlet side, the solenoid valve 12 is connected to the hydraulic pressure line P and to the hydraulic return R.

The individual electronic control devices 1 are coupled together via a data bus 13 serving to transmit data to and from the devices 1 and to and from a central control station.

To enable the various control functions to be carried out on a support unit, the corresponding control commands are inputted directly at the control devices 1 (or at a central control station) so that the respective solenoid valves 8 are controlled and switched via the electric control lines 9. Switching takes place in the pressure-free state as the associated solenoid valve 12 keeps the connecting line 10 initially free from pressure, i.e. connected to the return R. The solenoid valve 12 connected to the valve group is then switched so that the line 10 is connected to the pressure line P. The hydraulic control pressure which switches over the associated direction control valves 5 is therefore adjusted in the respective control lines 7 so that the respective working chambers are connected to the hydraulic pressure line P or the hydraulic return R in the desired manner.

Only some valves 5 and 8 are shown in FIG. 1. The support control means can also have, for example, two solenoid valves 12 on each valve unit, each solenoid valve 12 being associated with a group of solenoid valves 8 and consequently also a group of direction control valves 5.

Figure 2:
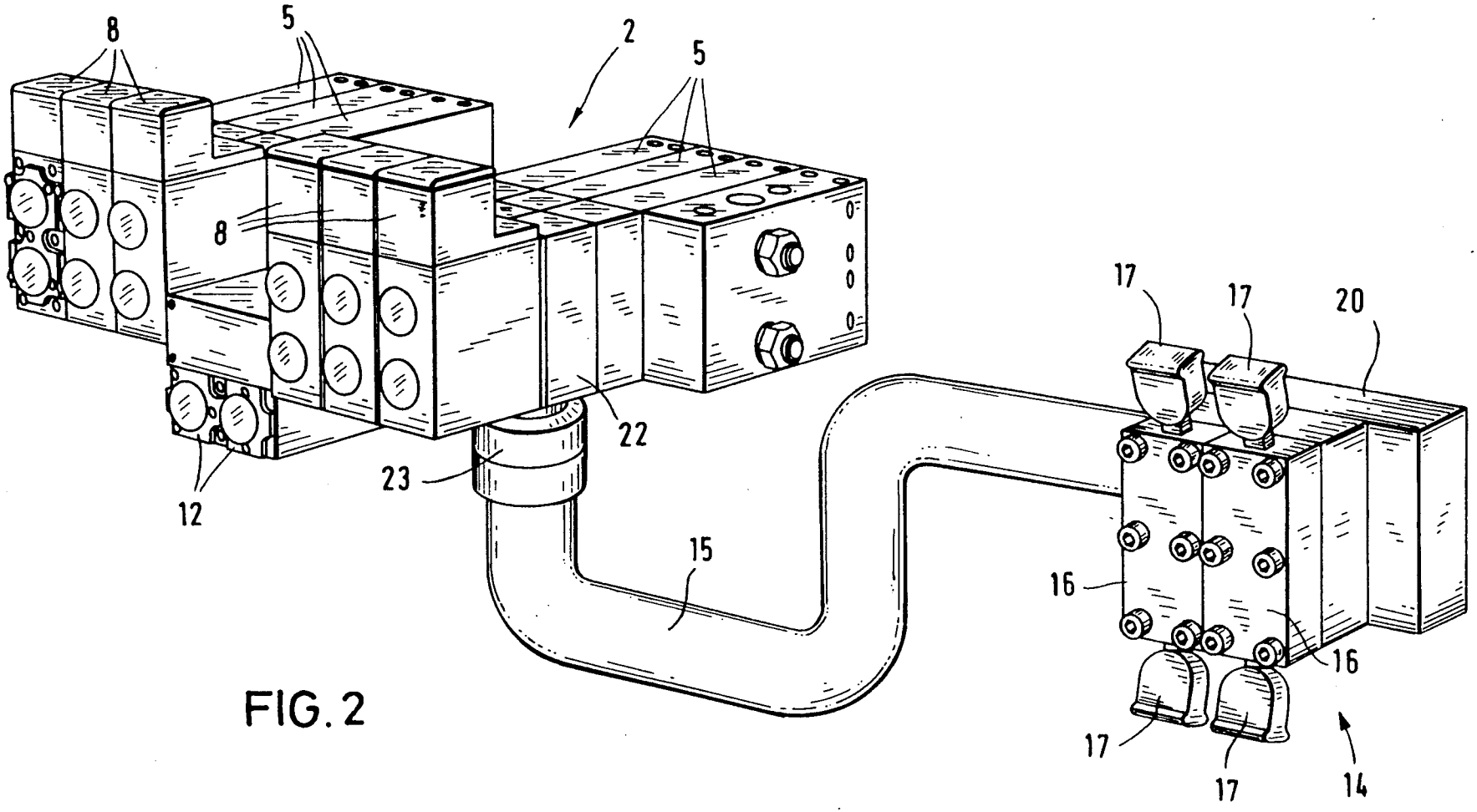
FIG. 2 is a perspective view of the emergency operation arrangement and its coupling to the valve block of the system.

It can be appreciated that the support cannot be operated during a power failure or a failure of the electronic control system. This can be dangerous and to overcome this difficulty and allow emergency operation, an emergency operation arrangement conveniently embodied as a compact device 14 is provided. The device 14 is connected via a multi-core hydraulic connecting cable 15 to the valve block 2 of the associated support. As shown in FIG. 2, the various valves 5,8 and 12 of a support are combined to form the valve block 2 which can also be combined with the control device 1 and the electric valve control unit 3 to form a constructional unit or is connected to the control device 1 via a cable. In the preferred embodiment illustrated, the emergency control device 14 comprises four emergency control valves 16 which can each be actuated via a manual lever 17 or some other actuator. On the outlet side, the emergency control valves 16 are each connected via a hydraulic branch line 18 to the associated control line 7, more specifically between the outlet of the associated solenoid valve 8 and the inlet of the associated direction control valve 5. A change-over valve 19 which closes the respective branch line 18 when the support is driven via the normal electro-hydraulic control is arranged at the connecting point between the lines 18 and 7. During emergency operation, the change-over valves 19 close the branch lines 7 to the respective solenoid valves 8 and consequently open the connection of the branch lines 18 to the control inlets of the direction control valves 5.

As shown in FIG. 2, the emergency control valves 16 are also combined with a connecting plate 20 to form a compact device 14. The connecting plate 20 has the relevant bores for the various hydraulic connections. It is preferably constructed such that the cable 15 can be connected to it by means of a coupling 21, preferably a plug-in coupling of known type. The individual hydraulic lines or cores of the connecting cable 15 form, with the corresponding bores in the valve blocks, the hydraulic branch lines 18. A connecting member or strip 22 (FIG. 2) which receives the change-over valves 19 and, with its bores provides the hydraulic connections between the relevant solenoid valves 8 and the associated direction control valves 5 forming the hydraulic control lines 7 is located on the valve block 2. The connecting strip 22 with the change-over valves 19 located therein preferably consists of a simple metal plate which is provided with the bores serving to connect the lines. A coupling 23 for receiving the multi-core cable 15 is also located on the connecting strip 22. This coupling 23 also preferably consists of a plug-in coupling of known type. A mechanical locking connection between the connecting cable 15 and the valve block 2 can be provided, for example, by means of a union nut, a plug-in fork or another quick-release coupling device.

The emergency control device 14 is preferably arranged on the adjacent support so that emergency control can be carried out in the protection of the adjacent support.

In the embodiment illustrated, only the main functions of the support, namely the retraction and setting of the props, the shifting of the conveyor and the advancing of the support can be controlled using the emergency control device 14, the hydraulic branch lines 18 with the change-over valves 19 obviously being connected to the relevant hydraulic control lines by means of which these sequences are controlled by the solenoid valves 8 and the relevant direction control valves 5.

The emergency control valves 16 are each connected on the inlet side via two branch lines P' and R', which lead through the multi-core cable 15, to the hydraulic pressure line P and the hydraulic return R. A check valve 24 is arranged in the branch line P' and a non-return valve 25 in the branch line R'. These valves 24 and 25 are preferably also located in the connecting strip 22 of the valve block 2. The check valves 24 can be so arranged in the valve blocks 2 of the support such that they automatically open when the coupling 23 is established. When the check valve 24 is opened, the emergency control valves 16 are therefore connected by their inlet to the hydraulic pressure line P so that the relevant branch lines 18 are connected to the hydraulic pressure line during manual actuation of these valves and the direction control valves 5 can be hydraulically switched via the branch line 18 and the opening change-over valves 19 while avoiding the solenoid valves 8, 12 and the entire electronic control system. If necessary, therefore, the hydraulic appliances can also be driven by purely hydraulic controls via the emergency operation arrangement.

The emergency control device 14 with the connecting cable 15 forms a conveniently portable arrangement which, if necessary, can be connected via the connecting cable 15 and the coupling 23 to any one of the valve blocks of the relevant supports, so that this support can be driven purely hydraulically at least in its above-mentioned main functions.

Figure 3:
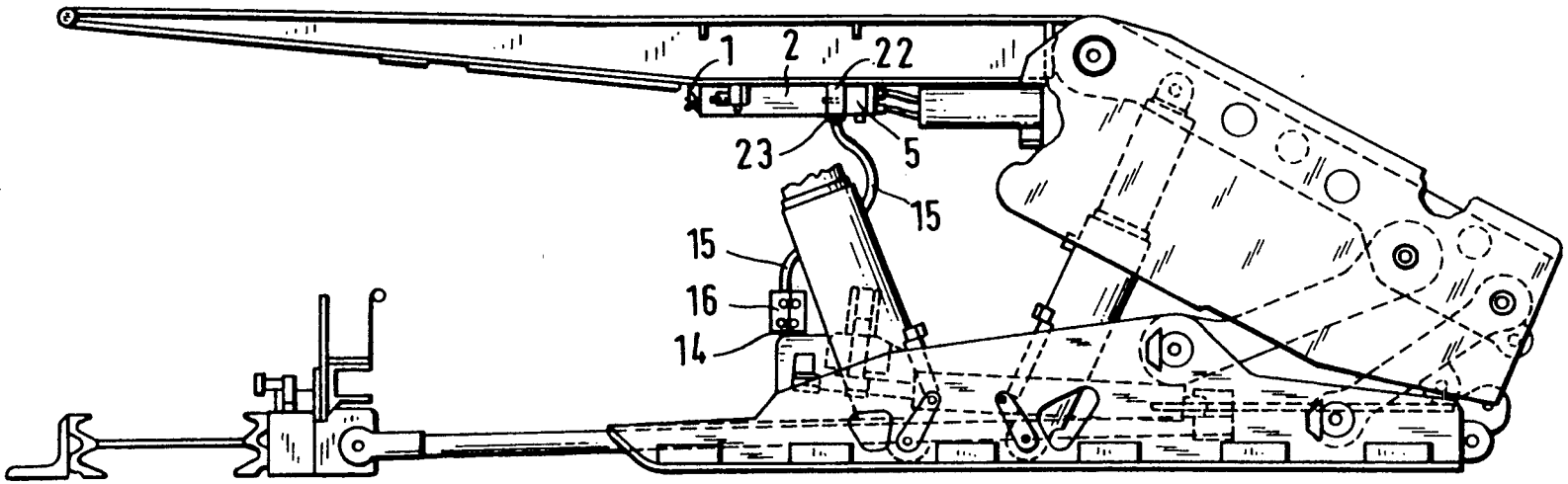
FIG. 3 is a schematic side view of a roof support of a mineral mining installation in accordance with the invention.

FIG. 3 shows a roof support of an installation equipped with the device and components discussed above. As shown, the roof support has a floor sill, a roof cap, a goaf shield and telescopic props therebetween. The floor sill is connected via shifting ram to a conveyor. The valve block 2 and the control device associated with the support is mounted beneath the roof cap while the device 14 is supported on the floor sill and connected with the cable 15 to the block 2 via the coupling 23.

We claim:

1. In a mineral mining installation comprising a plurality of supports equipped with hydraulic appliances and an electro-hydraulic control system for controlling the operation of the hydraulic appliances; said system comprising electronic control devices and valve units allocated to the supports, the valve units having hydraulically controllable direction control valves which are connected on an inlet side to hydraulic pressure and return lines and on an outlet side to pressure chambers of the appliances, and solenoid pilot valves which are controlled electrically by the associated control device and are arranged in hydraulic control lines of the control valves; an arrangement for effecting alternative operation of at least some of the appliances, said arrangement comprising a portable device with further manually actuatable control valves, a multi-core cable and complementary releasable coupling means for connecting the cable to any selected one of the valve units, the multi-core cable serving to connect the further valves of the device to said one valve unit to provide hydraulic pressure to the control lines of the control valves to operate these valves.

2. A system according to claim 1, wherein change-over valves are arranged in the hydraulic control lines and the cable establishes connection between the control lines and the further control valves via the change over valves.

3. A system according to claim 1, wherein the hydraulic pressure and return lines are connected via the cable to the device.

4. A system according to claim 3, wherein a check valve is provided in the valve unit in a branch line connected to the hydraulic pressure line.

5. A system according to claim 1, wherein the further valves are connectable with the cable to control some of the control valves of the valve unit to perform only the main functions of the support.

6. A system according to claim 1, wherein a connection means is provided on the valve unit and the connection means has bores leading to a component of the coupling means.

7. A system according to claim 6, wherein change over valves are arranged in the connection means and these change over valves are disposed in the hydraulic control lines and lead to the component of the coupling means for connection to the further valves of the device.

* * * * *